United States Patent [19]

Payne

[11] 4,401,964

[45] Aug. 30, 1983

[54] COMBINED TEMPERATURE RESPONSIVE VALVE CONSTRUCTION AND ELECTRICAL SWITCH CONSTRUCTION AND METHOD OF MAKING THE SAME

[75] Inventor: Frank Payne, Knoxville, Tenn.

[73] Assignee: Robertshaw Controls Company, Richmond, Va.

[21] Appl. No.: 254,378

[22] Filed: Apr. 15, 1981

[51] Int. Cl.[3] ..... H01H 37/74

[52] U.S. Cl. ..... 337/343; 337/347; 200/83 P

[58] Field of Search ..... 337/343, 347; 200/83 P

[56] References Cited

U.S. PATENT DOCUMENTS

| | | | |
|---|---|---|---|
| 3,553,402 | 1/1971 | Hire | 200/83 |
| 3,960,124 | 6/1976 | Payne | 337/401 X |
| 4,121,074 | 10/1978 | Orcutt et al. | 200/83 |
| 4,200,776 | 4/1980 | Poling | 200/83 P |
| 4,296,287 | 10/1981 | Boulanger et al. | 200/83 P |

*Primary Examiner*—George Harris

*Attorney, Agent, or Firm*—Candor, Candor & Tassone

[57] ABSTRACT

A combined temperature responsive valve construction and an electrical switch construction wherein the valve construction has a thermally responsive device of the piston and cylinder type operating a movable valve member that is engaged by the piston of the device and operates an actuator of the switch construction, the valve member comprising an axially movable valve stem having opposed ends one of which is engaged by the piston of the device and the other of which operates the actuator. A coiled compression spring has one of the opposed ends thereof engaging a spring retaining part of the other end of the valve stem in a retained manner and the other opposed end thereof engaging the actuator whereby axial movement of the valve stem toward the actuator will tend to compress the spring therebetween.

24 Claims, 5 Drawing Figures

COMBINED TEMPERATURE RESPONSIVE VALVE CONSTRUCTION AND ELECTRICAL SWITCH CONSTRUCTION AND METHOD OF MAKING THE SAME

BACKGROUND OF THE INVENTION

1. Field of the Invention

This invention relates to an improved combined temperature responsive valve construction and an electrical switch construction wherein the valve construction has a thermally responsive device of the piston and cylinder type, this invention also relating to an improved method of making such a combined temperature responsive valve construction and electrical switch construction.

2. Prior Art Statement

It is known to provide a combined temperature responsive valve construction and electrical switch construction wherein the valve construction has a thermally responsive device of the piston and cylinder type operating a movable valve member that is engaged by the piston of the device and that operates an actuator of the switch construction, the valve member comprising an axially movable valve stem having opposed ends one of which is engaged by the piston of the device and the other of which operates the actuator.

For example, see the following U.S. Patent: (1) U.S. Pat. No. 3,960,124—Payne.

It appears that the actuator of the combined temperature responsive valve construction and electrical switch construction of item (1) above comprises an insulating member that is directly engaged by the free end of the valve stem and carries a switch contact for movement relative to a fixed switch contact of the switch construction.

Another known combined temperature responsive valve construction and electrical switch construction has the piston means of the piston and cylinder device operate a ball valve member with the ball valve member acting on one end of a compression spring and with the other end of the compression spring acting on a snap disc of a snap-acting switch construction, the snap disc itself being part of the contact means for movement into engagement with a fixed contact means to provide the switching function of the device.

However, it is also known to provide a snap-acting switch construction wherein an insulating member is disposed between the snap disc and the movable switch blade of the switch construction so that the snap disc is not a current carrying member.

For example, see the following two U.S. Patents: (2) U.S. Pat. No. 3,553,402—Hire, (3) U.S. Pat. No. 4,121,074—Orcutt et al.

It appears that the snap-acting switch construction of item (2) above is pressure operated and the insulating member disposed between the snap disc thereof and a movable contact member actually carries the movable contact member in a manner to bridge a pair of terminals carried by the construction, the switch construction carrying an adjustable compression spring acting on the movable contact member in a direction opposite to the snap direction of the snap disc.

It appears that the pressure operated snap-acting switch construction in FIG. 10 of item (3) above has an insulating wall disposed between the snap disc and a movable switch blade carried by one of the terminals of the switch construction and through which an actuator is disposed to transmit movement of the snap disc to the switch blade so as to place its contact into contact with another terminal of the switch construction.

SUMMARY OF THE INVENTION

It is one feature of this invention to provide an improved combined temperature responsive valve construction and electrical switch construction wherein the valve construction has a thermally responsive device of the piston and cylinder type.

In particular, it was found according to the teachings of this invention that the prior known combined temperature responsive valve construction and electrical switch construction of applicant's earlier issued U.S. Pat. No. 3,960,124 could be improved if the same has the electrical switch means thereof be snap-acting rather than be of the slow make and break type.

Therefore, it was found according to the teachings of this invention that a snap disc could be utilized and the valve stem could act on the snap disc through the use of a compression spring so as not only to actuate the snap disc, but to also provide for overrun movement of the thermally responsive device. In this manner, it was found that the resulting combined temperature responsive valve construction and electrical switch construction of this invention has a high current rating and can be callibrated to a close tolerance.

For example, one embodiment of this invention provides a combined temperature responsive valve construction and electrical switch construction wherein the valve construction has a thermally responsive device of the piston and cylinder type operating a movable valve member that is engaged by the piston of the device and operates an actuator of the switch construction, the valve member comprising an axially movable valve stem having opposed ends of which is engaged by the piston of the device and the other of which operates the actuator and has a spring retaining means. A coiled compression spring has one of the opposed ends thereof engaging the spring retaining means of the other end of the valve stem in a retained manner and the other opposed end of the spring engaging the actuator whereby axial movement of the valve stem toward the actuator will tend to compress the spring therebetween.

Accordingly, it is an object of this invention to provide an improved combined temperature responsive valve construction and electrical switch construction having one or more of the novel features of this invention as set forth above or hereinafter shown or described.

Another object of this invention is to provide a method of making such a combined temperature responsive valve construction and electrical switch construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
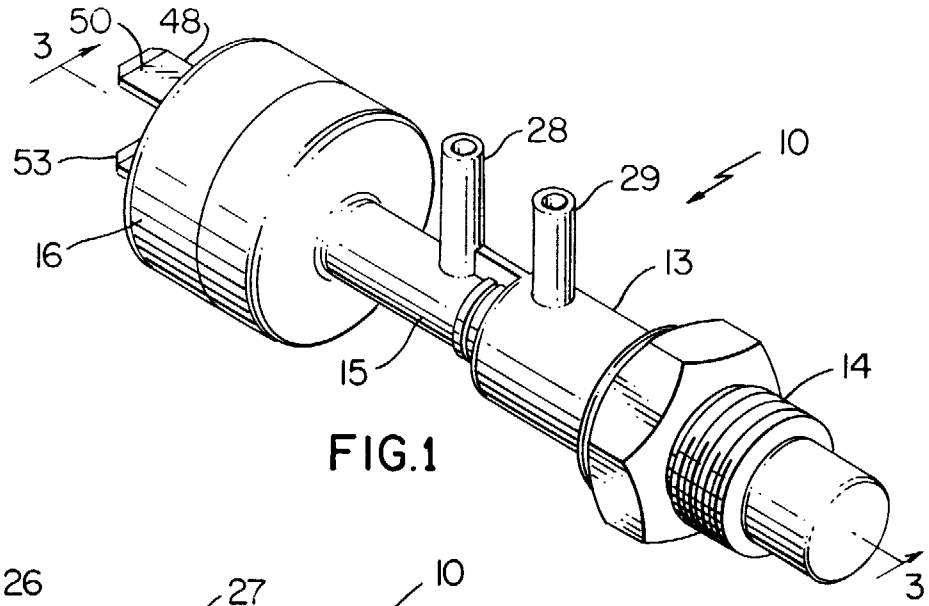
FIG. 1 is a perspective view illustrating the improved combined temperature responsive valve construction and electrical switch construction of this invention.

While the various features of this invention are hereinafter described and illustrated as being particularly adapted to provide a combined temperature responsive valve construction and electrical switch construction to be utilized with an internal combustion engine as set forth in the U.S. Pat. No. 3,960,124, it is to be understood that the various features of this invention can be utilized singly or in various combinations thereof to provide a combined temperature responsive valve construction and electrical switch construction for use with other structures as desired.

Therefore, this invention is not to be limited to only the embodiment illustrated in the drawings, because the drawings are merely utilized to illustrate one of the wide variety of uses of this invention.

However, in order to fully understand a typical use of the improved unit of this invention, reference can be made to such U.S. Pat. No. 3,960,124 for a full disclosure thereof and, therefore, the U.S. Pat. No. 3,960,124 is being incorporated into this disclosure by reference thereto.

Figure 2:
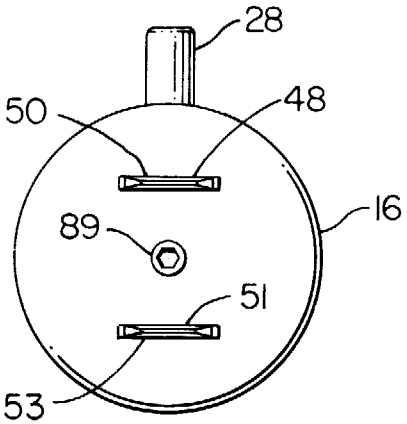
FIG. 2 is an end view of the combined temperature responsive valve construction and electrical switch construction of FIG. 1.
Figure 3:
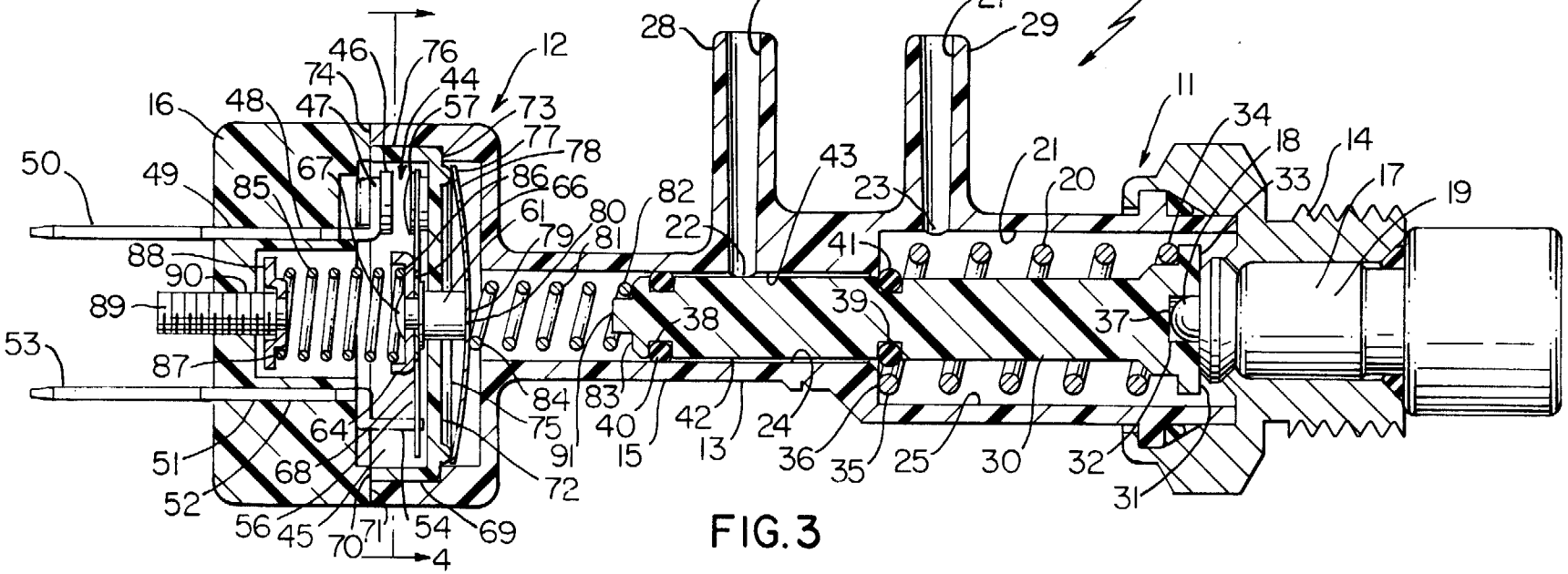
FIG. 3 is an enlarged cross-sectional view taken on line 3—3 of FIG. 1.
Figure 4:
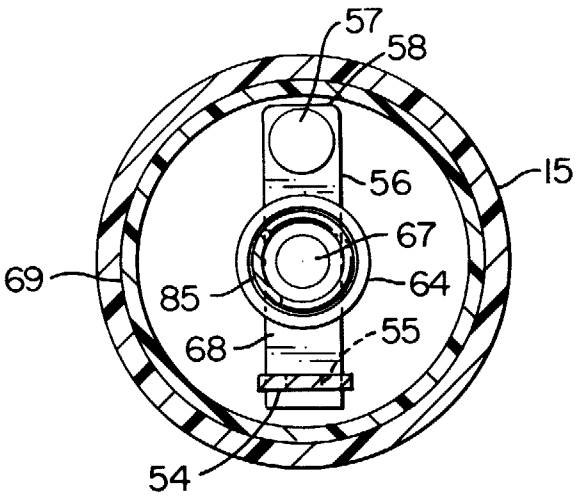
FIG. 4 is a cross-sectional view taken on line 4—4 of FIG. 3.

Referring now to FIGS. 1-3, the improved combined temperature responsive valve construction and electrical switch construction or unit of this invention is generally indicated by the reference numeral 10 with the temperature responsive valve construction or portion thereof being generally indicated by the reference numeral 11 and the electrical switch construction or portion thereof being generally indicated by the reference numeral 12, the constructions 11 and 12 being interconnected together by a housing means 13 formed from a plurality of housing parts 14, 15 and 16 suitably secured together as illustrated in FIG. 3.

The thermally responsive valve construction 11 includes a thermally responsive device 17 of the piston and cylinder type wherein a piston 18 is carried by a cylinder means 19 to be extended out of the same when a wax charge or the like in the cylinder 19 has the volume thereof increased by sensing a predetermined temperature and being retracted into the cylinder 19 under the force of a compression spring 20 when the wax charge or the like in the cylinder 19 decreases in volume because of sensing a temperature below the predetermined temperature in a manner well known in the art.

The housing part 14 is secured to the cylinder 19 of the thermally responsive device 17 so that the device 17 is carried by the housing means 13 and has the piston 18 thereof projecting into a stepped bore means 21 passing axially through the housing member 15.

The housing member 15 has a pair of ports 22 and 23 respectively interrupting a small section 24 of the bore 21 and a large section 25 of the bore 21 as illustrated, the ports 22 and 23 comprising the inner ends of a pair of passage means 26 and 27 passing respectively through a pair of outwardly directed nipples 28 and 29 formed integrally with the housing member 15, such as by molding or the like of suitable plastic material or the like.

A plunger-like valve stem 30 is disposed in the stepped bore 21 of the housing member 15 and has one end 31 thereof interrupted by a bore 32 which is adapted to receive the piston 18 therein as illustrated in FIG. 3, the end 31 of the valve stem 30 having an annular flange 33 against which one end 34 of the compression spring 20 engages while the other end 35 of the spring 20 engages against a shoulder 36 of the housing member 13 defined between the bore sections 24 and 25 as illustrated. In this manner, the force of the compression spring 20 maintains a closed end 37 of the valve stem 30 against the piston 18 of the thermally responsive device 17 so as to follow movement thereof in a manner well known in the art.

The valve stem 30 has a pair of spaced apart annular grooves 38 and 39 formed therein and respectively receiving annular resilient O-ring like members 40 and 41 which extend respectively radially outwardly from the external peripheral surface 42 of the valve stem 30.

In this manner, the resilient seal member 40 seals against the internal peripheral surface 43 of the housing member 15 in the bore section 24 while the resilient O-ring member 41 is adapted to seal against such surface 43 when the same is moved into the bore section 24 upon the extension of the piston 18 out of the cylinder 19 of the thermally responsive device 17. However, when the thermally responsive device 17 is sensing a temperature below the previously described predetermined temperature, the seal member 41 is spaced from the shoulder 36 of the housing member 15 so that the ports 22 and 23 are fluidly interconnected together as the external peripheral surface 42 of the valve stem 30 is spaced inwardly from the internal peripheral surface 43 of the bore section 24 as illustrated in FIG. 3. However, when the piston 18 of the thermally responsive device 17 is extended to the left in FIG. 3 a sufficient distance to cause the seal member 41 to be received in the bore section 25 and seal against the internal peripheral surface 43 thereof, fluid communication between the ports 22 and 23 is terminated in a manner well known in the art.

In all positions of the valve stem 30, the seal 40 seals the ports 22 and 23 from the switch construction 12.

The electrical switch construction 12 of the unit 10 comprises an electrical switch means that is generally indicated by the reference numeral 44 disposed in a chamber 45 formed between the cooperating housing members 15 and 16.

The switch means 44 includes a fixed contact 46 carried on an end 47 of a terminal 48 passing through an opening means 49 in the housing member 16 so that its outer end 50 is adapted for external electrical interconnection purposes.

Figure 5:
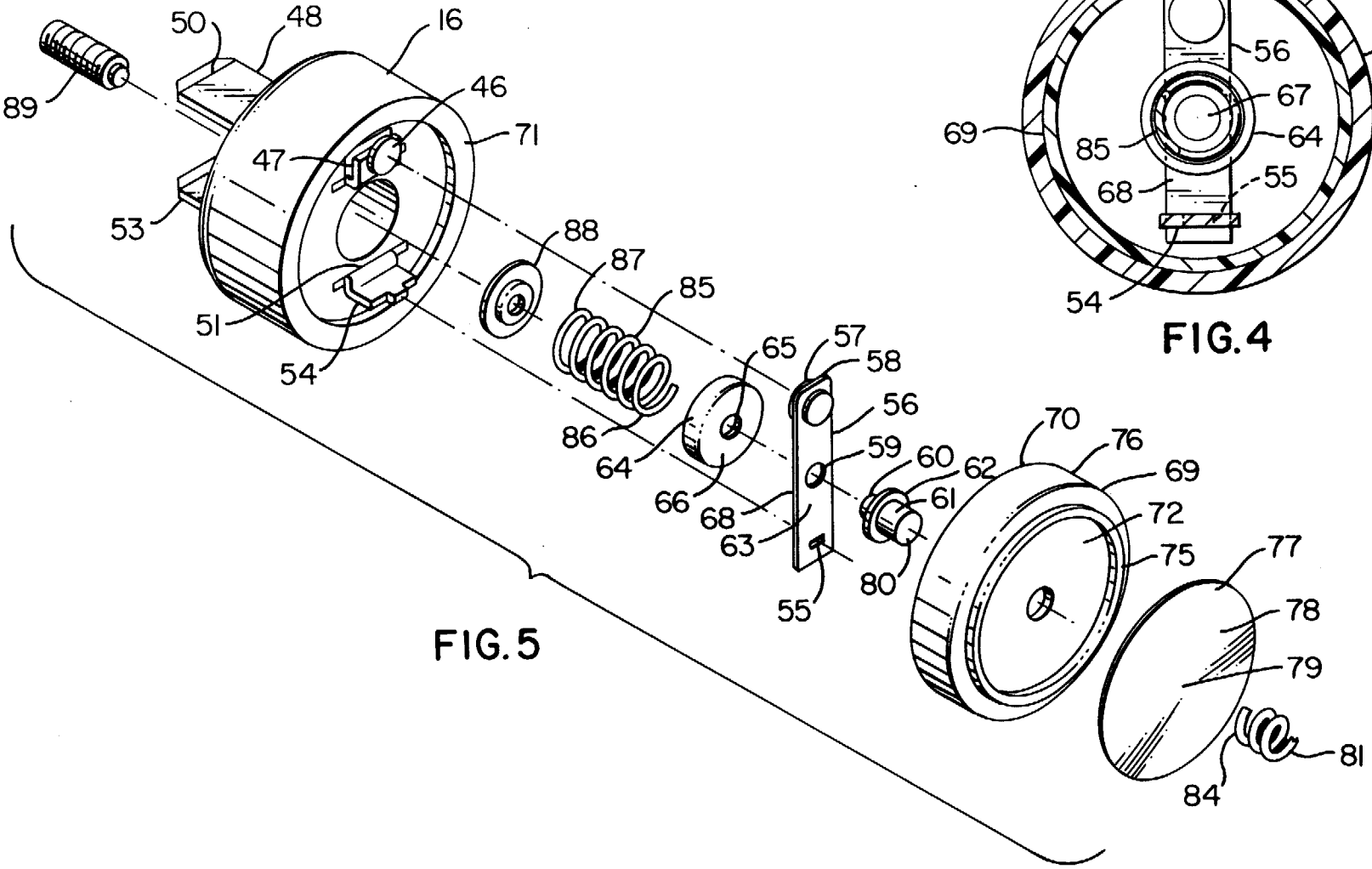
FIG. 5 is an exploded perspective view of the switch construction part of the combined temperature responsive valve construction and electrical switch construction of FIGS. 1 and 3.

Similarly, another terminal 51 passes through an opening means 52 in the housing member 16 so that its outer end 53 is adapted for external electrical connection purposes while its inner end 54 is received in an opening 55, FIG. 5, of a switch blade 56 that carries an electrical contact 57 on the outer end 58 thereof and thereby comprises a movable contact cooperable with the fixed contact 46 as will be apparent hereinafter as the blade 56 is riveted on the end 54 of the terminal 51.

The switch blade 56 has an opening 59 passing therethrough and receiving a reduced end 60 of an electrically insulating actuating member 61, the actuating member 61 having an annular flange 62 which abuts against the side 63 of the switch blade 56 when the reduced portion 60 is fully telescoped through the opening 59 of the switch blade 56 as illustrated in FIG. 3.

A cup-shaped spring retainer 64 has an opening 65 passing through the closed end 66 thereof and receives the reduced portion 60 of the actuating member 61 therein which is subsequently turned over to form a rivet head 67 so as not only to secure the actuating member 61 to the switch blade 56, but also to secure the spring retainer 64 thereto with its end wall 66 disposed against the side 68 of the switch blade 56 as illustrated in FIG. 3.

An electrically insulating cup-shaped member 69 is disposed in the chamber 45 and has its open end 70 disposed against the end 71 of the housing member 16 while its closed end 72 is engaged by an internal shoulder 73 of the housing member 15 when the housing member 15 has its end 74 secured to the end 71 of the housing member 16 in any suitable manner whereby the cup-shaped member 69 is prevented from movement in the chamber 45.

The closed end 72 of the cup-shaped member 69 has an annular flange or bead 75 disposed inboard of the outer peripheral surface 76 of the cup-shaped member 69 and is adapted to be engaged by the outer peripheral portion 77 of a metallic snap disc or actuator 78 which is carried in the chamber 45 of the housing means 13 and has its medial portion 79 engaging against the end 80 of the electrically insulating actuating member 61 as illustrated in FIG. 3.

A coiled compression spring 81 is disposed in the stepped bore 21 of the housing means 13 and has one end 82 bearing against the free end or end surface 83 of the valve stem 30 while the other end 84 of the spring 81 bears against the medial portion 79 of the snap disc or actuator 78 in coaxial alignment with the actuating member 61 so that the medial portion 79 of the snap disc 78 will be urged to the left in FIG. 3 by the force of the compression spring 81 between the end 83 of the valve stem 80 and the medial portion 79 of the snap disc 78.

As will be apparent hereinafter, suitable callibration of the electrical switch means 44 will cause the snap disc 78 to snap over center and have its medial portion 79 moved in a snap manner to the left in FIG. 3 when the force of the compression spring 81 has been increased by the valve stem 30 being moved to the left by the extending piston 18 of the thermally responsive device 17 a certain distance so that the movable contact 57 will be snapped against the fixed contact 56 to complete the electrical circuit between the terminals 48 and 51.

Conversely, when the force of the compression spring 81 is relaxed sufficiently to cause the medial portion 79 of the snap disc 78 to snap back to the right as illustrated in FIG. 3, the switch blade 56 is adapted to snap the movable contact 57 away from the fixed contact 46 by the force of a coiled compression spring 85 disposed in the chamber 45 and having one end 86 thereof bearing against the closed end 66 of the cup-shaped spring retainer 64 while the other end 87 thereof bears against a spring retainer 88 carried on a threaded adjusting member 89 threadedly disposed in a threaded bore 90 of the housing member 16.

In this manner, the force of the compression spring 85 tending to hold the switch blade 56 against the closed end 72 of the cup-shaped member 69 can be adjusted by changing the axial threaded relation between the threaded adjusting member 89 and the threaded bore 90 of the housing member 16.

The end 82 of the compression spring 81 that acts on the snap disc 78 is positively located in a retained manner on the end 83 of the valve stem 30 because the end 83 of the valve stem 30 has an integral projection 91 extending therefrom and being telescopically received in the end 82 of the coiled spring 81 so that the coiled spring 81 will be properly axially aligned not only with the valve stem 30 and the actuating member 61, but is also axially aligned with the compression spring 85 as illustrated. Thus, the end surface 83 and projection 91 of the valve stem 30 define a spring retaining means thereof.

Therefore, it can be seen that the combined temperature responsive valve construction and electrical switch construction or unit 10 of this invention can be formed in a relatively simple manner by the method of this invention as previously set forth to operate in a manner now to be described.

Assuming that the unit 10 is being utilized with an internal combustion engine in the same manner as the unit of the aforementioned U.S. Pat. No. 3,960,124 and has the temperature responsive device 17 sensing a temperature of the engine that is below the predetermined temperature that causes the piston 18 to be extended from the cylinder 19, the unit 10 is in the condition illustrated in FIG. 3 wherein the sealing member 41 is spaced to the right from the shoulder 36 of the housing member 15 so that fluid communication is permitted between the ports 22 and 23 for any desired control purpose. Also, because the piston 18 is fully retracted in the cylinder 19 so that the end 31 of the valve stem 30 is against the cylinder 19 under the force of the compression spring 20, the force of the compression spring 81 is not sufficient to overcome the force of the compression spring 85 and the snap disc 78 so that the snap disc 78 is in the bowed condition illustrated in FIG. 3 wherein the medial portion 79 thereof is to the right and the compression spring 85 holds the switch blade 56 against the closed end 72 of the cup-shaped member 69 whereby the switch means 44 is in an open condition as the movable contact 57 is held out of contact with the fixed contact 46 so that an electrical circuit between the terminals 48 and 51 is prevented.

However, upon the device 17 sensing a temperature above the predetermined temperature, the piston 18 is extended to the left in FIG. 3 out of the cylinder 19 in opposition to the force of the compression spring 20 and axially moves the valve stem 30 to the left in FIG. 3 a sufficient distance so that the annular sealing member 41 enters the bore section 24 and seals against the internal peripheral surface 43 of the housing member 15 to terminate fluid communication between the ports 22 and 23. Also, when the valve stem 30 has been moved to the left in FIG. 3 a sufficient distance, the resulting increase in the compressive force of the compression spring 81 overcomes the force of the snap disc 78 and the compression spring 85 to snap the medial portion 79 of the snap disc 78 to the left in FIG. 3 and thereby snap the switch blade 56 to the left so that its contact 57 will be snapped into electrical contact with the fixed contact 46 to complete the electrical circuit between the terminals 48 and 51.

As long as the piston 18 remains extended from the cylinder 19 of the device 17 by the device 17 sensing a temperature at the predetermined temperature or above, the switch means 44 remains closed and the port means 22 and 23 remain sealed from each other.

However, when the temperature being sensed by the device 17 falls below the predetermined temperature, the force of the compression spring 20 is adapted to retract the piston 18 into the cylinder 19 and thereby move the valve stem 30 back to the condition illustrated in FIG. 3 wherein not only is the sealing member 41 now moved away from the bore section 24 so that the ports 22 and 23 are again in fluid communication with each other, but also the force of the compression spring 81 has been diminished sufficiently that the force of the compression spring 85 and the natural bias of the snap disc 78 causes the medial portion 79 of the snap disc 78 to snap back to the condition illustrated in FIG. 3 and thereby permit the compression spring 85 to move the movable contact 56 with a snap action away from the fixed contact 46 to again open the electrical switch means 44.

From the above, it can readily be seen that the electrical switch means 44 can have a high current rating and can be calibrated to a close tolerance through the adjusting member 89 in the manner previously set forth.

Therefore, it can be seen that this invention not only provides an improved combined temperature responsive valve construction and electrical switch construction, but also this invention provides an improved method of making such a combined temperature responsive valve construction and electrical switch construction.

While the form and method of this invention now preferred has been described and illustrated as required by the Patent Statute, it is to be understood that other forms and method steps can be utilized and still fall within the scope of the appended claims.

What is claimed is:

1. In a combined temperature responsive valve construction and an electrical switch construction wherein said valve construction has a thermally responsive device of the piston and cylinder type operating a movable valve member that is engaged by said piston of said device and that operates an actuator of said switch construction, said valve member comprising an axially movable valve stem having opposed ends one of which is engaged by said piston of said device and the other of which operates said actuator, the improvement wherein said other end of said valve stem has spring retaining means, and a coiled compression spring having opposed ends one of which engages in a retained manner said spring retaining means of said other end of said valve stem and the other of which engages said actuator whereby axial movement of said valve stem toward said actuator will tend to compress said spring therebetween.

2. A combined temperature responsive valve construction and an electrical switch construction as set forth in claim 1 wherein said other end of said valve stem has an end surface with a projection thereon and received in said one end of said spring to act as a spring retainer therefor, said one end of said spring engaging said end surface whereby said projection and said end surface of said valve stem define said spring retaining means thereof.

3. A combined temperature responsive valve construction and an electrical switch construction as set forth in claim 2 wherein said valve stem has a plurality of spaced apart annular grooves therein, and a plurality of annular sealing members respectively disposed in said annular grooves to provide a sealing function with said valve stem.

4. A combined temperature responsive valve construction and an electrical switch construction as set forth in claim 3 wherein said valve stem comprises a one-piece member.

5. A combined temperature responsive valve construction and an electrical switch construction as set forth in claim 1 wherein said switch construction has a snap-acting electrical switch means.

6. A combined temperature responsive valve construction and an electrical switch construction as set forth in claim 5 wherein said actuator comprises a snap disc and thereby provides the snap-acting function for said electrical switch means.

7. A combined temperature responsive valve construction and an electrical switch construction as set forth in claim 6 wherein said electrical switch means includes a movable switch blade having a bias means that tends to cause said switch blade to remain in one operating position thereof, and an electrical insulating actuator member disposed between said switch blade and said snap disc to transmit movement of said snap disc to said switch blade and thereby move said switch blade to another operating position thereof.

8. A combined temperature responsive valve construction and an electrical switch construction as set forth in claim 7 wherein said electrical switch means includes a cup-shaped member having a closed end and open end, said closed end having an opening therethrough and telescopically receiving said actuator member for axial movement therein, said closed end being intermediate said switch blade and said snap disc.

9. A combined temperature responsive valve construction and an electrical switch construction as set forth in claim 8 wherein said closed end of said cup-shaped member has an annular flange thereon and against which said snap disc engages.

10. A combined temperature responsive valve construction and an electrical switch construction as set forth in claim 9 wherein said bias means of said switch blade comprises another coiled compression spring, and adjusting means carried by said switch construction for adjusting the force of said other compression spring.

11. A combined temperature responsive valve construction and an electrical switch construction as set forth in claim 10 wherein said other spring acts on said switch blade in a direction opposite to the direction said first-named spring acts on said snap disc.

12. A combined temperature responsive valve construction and an electrical switch construction as set forth in claim 11 wherein said springs and said valve stem are disposed in axially aligned relation.

13. In a method of making a combined temperature responsive valve construction and an electrical switch construction wherein said valve construction has a thermally responsive device of the piston and cylinder type operating a movable valve member that is engaged by said piston of said device and that operates an actuator of said switch construction, said valve member comprising an axially movable valve stem having opposed ends one of which is engaged by said piston of said device and the other of which operates said actuator, the improvement comprising the steps of forming said other end of said valve stem to have spring retaining means, and disposing a coiled compression spring so that one opposed end thereof engages said spring retaining means of said other end of said valve stem in a retained manner and the other opposed end thereof engages said actuator whereby axial movement of said valve stem toward said actuator will tend to compress said spring therebetween.

14. A method of making a combined temperature responsive valve construction and an electrical switch construction as set forth in claim 13 and including the steps of forming said other end of said valve stem to have an end surface with a projection thereon, and telescoping said projection in said one end of said spring to act as a spring retainer therefor and cause said one end of said spring to engage said end surface whereby said projection and said end surface of said valve stem define said spring retaining means thereof.

15. A method of making a combined temperature responsive valve construction and an electrical switch construction as set forth in claim 14 and including the steps of forming said valve stem with a plurality of spaced apart annular grooves therein, and disposing a plurality of annular sealing members respectively in said annular grooves to provide a sealing function with said valve stem.

16. A method of making a combined temperature responsive valve construction and an electrical switch construction as set forth in claim 15 and including the step of forming said valve stem to comprise a one-piece member.

17. A method of making a combined temperature responsive valve construction and an electrical switch construction as set forth in claim 13 and including the step of forming said switch construction to be a snap-acting electrical switch means.

18. A method of making a combined temperature responsive valve construction and an electrical switch construction as set forth in claim 17 and including the step of forming said actuator to comprise a snap disc and thereby provide the snap-acting function for said electrical switch means.

19. A method of making a combined temperature responsive valve construction and an electrical switch construction as set forth in claim 18 and including the steps of forming said electrical switch means with a movable switch blade having a bias means that tends to cause said switch blade to remain in one operating position thereof, and disposing an electrical insulating actuator member between said switch blade and said snap disc to transmit movement of said snap disc to said switch blade and thereby move said switch blade to another operating position thereof.

20. A method of making a combined temperature responsive valve construction and an electrical switch construction as set forth in claim 19 and including the steps of forming said electrical switch means to include a cup-shaped member having a closed end and open end, forming an opening through said closed end, and telescopically disposing said actuator member in said opening for axial movement therein whereby said closed end is intermediate said switch blade and said snap disc.

21. A method of making a combined temperature responsive valve construction and an electrical switch construction as set forth in claim 20 and including the steps of forming said closed end of said cup-shaped member to have an annular flange thereon, and engaging said snap disc against said flange.

22. A method of making a combined temperature responsive valve construction and an electrical switch construction as set forth in claim 21 and including the steps of forming said bias means of said switch blade to comprise another coiled compression spring, and disposing adjusting means to be carried by said switch construction for adjusting the force of said other compression spring.

23. A method of making a combined temperature responsive valve construction and an electrical switch construction as set forth in claim 22 and including the step of causing said other spring to act on said switch blade in a direction opposite to the direction said first-named spring acts on said snap disc.

24. A method of making a combined temperature responsive valve construction and an electrical switch construction as set forth in claim 23 and including the step of disposing said springs and said valve stem so that the same are in axially aligned relation.

* * * * *